US011140975B1

(12) United States Patent
Lesch

(10) Patent No.: US 11,140,975 B1
(45) Date of Patent: Oct. 12, 2021

(54) PROTECTOR FOR A CONCRETE BROOM OR THE LIKE

(71) Applicant: Michael Lesch, Omaha, NE (US)

(72) Inventor: Michael Lesch, Omaha, NE (US)

( * ) Notice: Subject to any disclaimer, the term of this patent is extended or adjusted under 35 U.S.C. 154(b) by 0 days.

(21) Appl. No.: 17/128,566

(22) Filed: Dec. 21, 2020

Related U.S. Application Data

(63) Continuation-in-part of application No. 14/789,408, filed on Jul. 1, 2015, which is a continuation of application No. 13/524,425, filed on Jun. 15, 2012, now abandoned.

(51) Int. Cl.
*A46B 17/00* (2006.01)
*A46B 17/04* (2006.01)

(52) U.S. Cl.
CPC ..... *A46B 17/04* (2013.01); *A46B 2200/302* (2013.01)

(58) Field of Classification Search
CPC ..... A46B 17/04; A46B 17/02; A46B 17/00; A46B 2200/302; A46B 15/0095; A46B 3/08; A44D 3/125; A47L 13/24; A47L 13/51
USPC ..... 15/184, 247, 146; 206/15.2
See application file for complete search history.

(56) References Cited

U.S. PATENT DOCUMENTS

| | | | | |
|---|---|---|---|---|
| 1,335,654 | A | 3/1920 | Cantor et al. | |
| 1,388,224 | A | 8/1921 | Ward | |
| 2,043,758 | A | 6/1936 | Lay | |
| 5,249,719 | A * | 10/1993 | Hulyk | A47G 25/481 223/95 |
| D374,991 | S | 10/1996 | Trapp | |
| 5,661,868 | A | 9/1997 | Panagakos et al. | |
| 5,924,566 | A | 7/1999 | Gibbs | |
| 6,338,406 | B1 * | 1/2002 | Zagar | A46B 17/04 206/15.3 |
| 8,025,347 | B1 | 9/2011 | Solis | |
| 8,074,796 | B1 * | 12/2011 | Andrews | B65D 25/105 206/361 |
| 2015/0351574 | A1 * | 12/2015 | Eslami | A47G 25/54 206/388 |

* cited by examiner

*Primary Examiner* — Joseph J Hail
*Assistant Examiner* — Arman Milanian
(74) *Attorney, Agent, or Firm* — Dennis L. Thomte; Thomte Patent Law Office LLC

(57) ABSTRACT

A protector is provided for a broom such as a concrete broom or the like. The protector of this invention is clamped onto the bristles of a concrete broom or the like to protect the same.

6 Claims, 7 Drawing Sheets

PROTECTOR FOR A CONCRETE BROOM OR THE LIKE

This is a Continuation-in-Part Application of the application entitled A PROTECTOR FOR A CONCRETE BROOM OR THE LIKE, Ser. No. 14/789,408 filed Jul. 1, 2015, which is a Continuation application of the application entitled A PROTECTOR FOR A CONCRETE BROOM OR THE LIKE, Ser. No. 13/524,425 filed Jun. 15, 2012.

BACKGROUND OF THE INVENTION

Field of the Invention

The instant invention relates to a protector or cover for a broom such as a concrete broom or the like. More particularly, this invention relates to a protector which is clamped onto the bristles of a concrete broom or the like to protect the same. Even more particularly, the instant invention relates to a handle which is secured to the outer end of the clamping lever of the clamp.

Description of the Related Art

Concrete brooms are used to apply a non-slip finish to newly finished concrete surfaces. A concrete broom normally is comprised of an elongated, generally rectangular block having bristles set thereinto. An elongated handle is normally secured to the block. When the broom has been used to finish a concrete surface, it is frequently placed into the box of a truck or the like. The bristles of the broom frequently become bent, flared out or damaged during periods of non-use. Subsequent use of the broom becomes difficult and will have an effect on the finish of the concrete. In Applicant's earlier protectors, a hook was provided at the outer end of the clamping lever of the associated clamp. Although the hook provided a convenient way to hang the protector during periods of non-use, the hook made it somewhat difficult to grasp to move the associated clamping member between the non-clamping position and the clamping position and vice versa.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A protector for a concrete broom is disclosed which includes an elongated rectangular block having flexible bristles extending therefrom. The protector of this invention comprises a first elongated clamping member having a first end, a second end, a first side edge, a second side edge, an inner surface, and an outer surface. The protector also includes a second elongated clamping member having a first end, a second end, a first side edge, a second side edge, an inner surface, and an outer surface.

A pivotal clamp or clamps pivotally connect the first and second clamping members together so that the first and second clamping members may be selectively movable with respect to one another between a closed clamping position and an open non-clamping position. The first and second clamping members, when in the open non-clamping position, permit the bristles of the concrete broom to be inserted therebetween. The first and second clamping members are movable to their closed clamping position, after the bristles of the broom have been inserted therebetween, to clamp the bristles therebetween to protect the bristles from damage. The clamp or clamps have an elongated clamping lever, having inner and outer ends, with the inner end thereof being operatively connected to the clamp or clamps for moving the clamp between open and closed positions. The outer end of the clamping lever has a transversely extending handle or grip secured thereto. The handle or grip may be grasped by the person using the clamp to easily move the associated clamp between open and closed positions.

It is therefore a principal object of the invention to provide a protector for a concrete broom or the like.

A further object of the invention is to provide a protector for a concrete broom or the like which is easy to use.

A further object of the invention is to provide a protector for a concrete broom which securely clamps the bristles of the concrete broom between a pair of clamping members to protect the bristles from damage.

A further object of the invention is to provide a protector clamp, which includes an elongated clamping lever associated therewith, wherein the outer end of the clamping lever thereof has a transversely extending handle or grip mounted on the outer end of the clamping lever.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
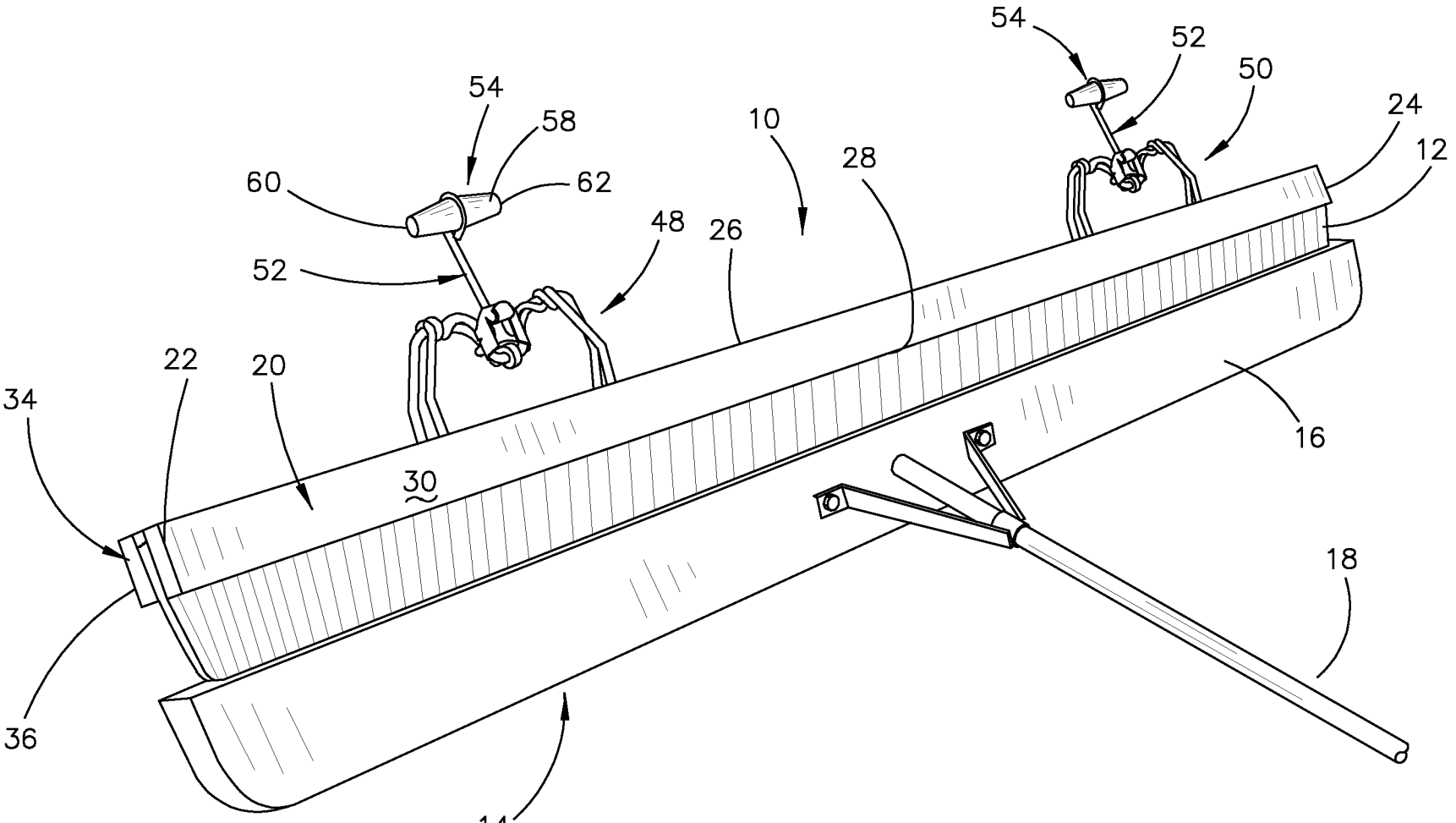
FIG. 1 is a perspective view of one embodiment of the invention being clamped onto the bristles of a concrete broom.
Figure 2:
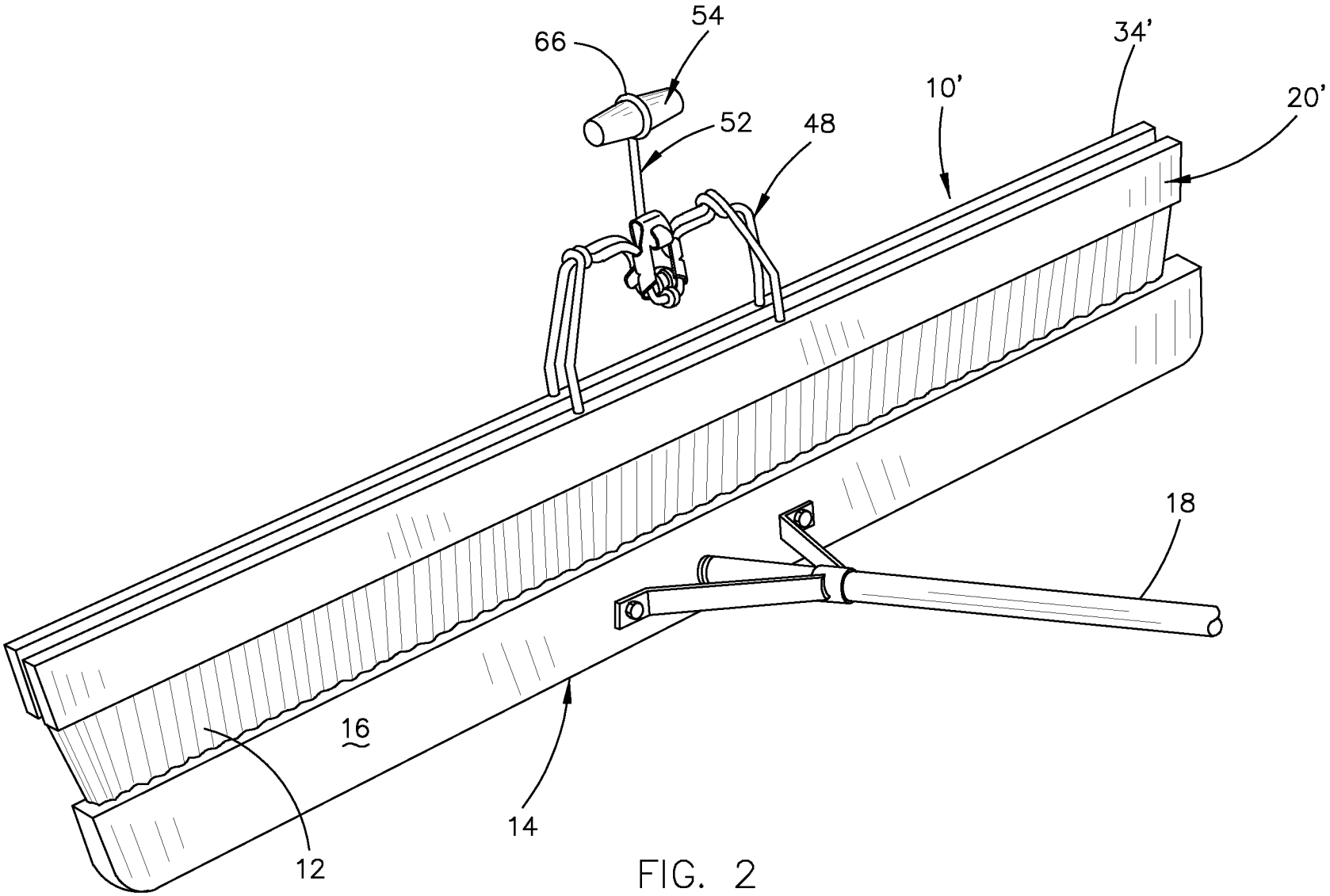
FIG. 2 is a perspective view of a second embodiment of the invention.

In the drawings, two embodiments of the invention are shown. In FIG. 1, the numeral 10 refers to the first embodiment of the protector of this invention while the numeral 10' refers to the second embodiment of the protector of this invention which is shown in FIG. 2.

Figure 5:
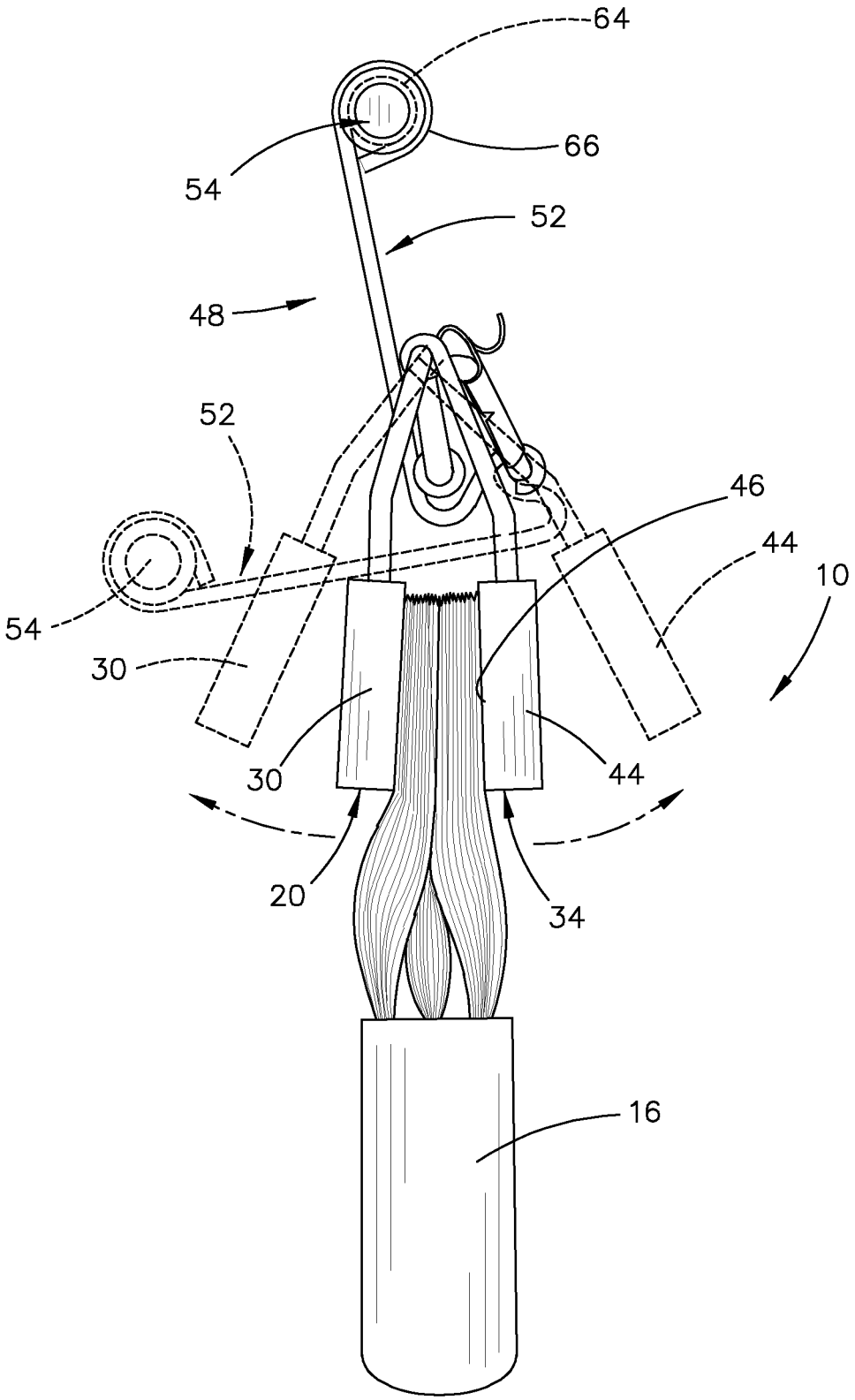
FIG. 5 is an end view illustrating the manner in which the clamping members may be clamped onto the bristles of the concrete broom.

Protectors 10 and 10' are designed to be used to protect the bristles 12 of a concrete broom 14. The protectors 10 and 10' could also be used to protect the bristles of other types of brooms as well. Broom 14 is conventional in design and includes an elongated, generally rectangular block 16 having a handle 18 secured thereto. The bristles 12 are usually arranged in rows as seen in FIG. 5. The inner ends of the bristles 12 are secured to the block 16 in conventional fashion.

Protectors 10 and 10' are identical except for the fact that two clamps are utilized on protector 10 rather than a single clamp being utilized on 10'. For that reason, only portions of protector 10 will be described in detail with "" being used to designate identical structure on protector 10'.

Protector 10 includes an elongated, flat, rectangular first clamping member 20 having a first end 22, a second end 24, a first side edge 26, a second side edge 28, an outer surface 30 and an inner surface 32. Protector 10 also includes an elongated, flat, rectangular second clamping member 34 having a first end 36, a second end 38, a first side edge 40, a second side edge 42, an outer surface 44 and an inner surface 46. The clamping members 20 and 34 may be 24 inches long or any other length such as 48 inches or longer.

Clamps 48 and 50 pivotally interconnect clamping members 20 and 34. Clamps 48 and 50 are movable between clamping and non-clamping positions as seen in FIG. 5. Clamps 48 and 50 differ from conventional pants hangers in that the hanger hooks normally secured to the outer ends of the clamps lever are not used in the instant invention. Clamp 48 includes an elongated clamping lever 52, the lower end of which is operatively connected to the clamp mechanism for moving the associated clamp between clamping and non-clamping positions. The numeral 54 refers to a transversely extending handle or grip having truncated conical-shaped end portions 56 and 58. As seen, the ends 60 and 62 of end portions 56 and 58 are blunt. Handle 54 has an annular groove 64 formed therein between end portions 56 and 58. The outer end of clamping lever 52 has a circular portion 66 which is received in groove 64 to secure handle 54 to clamping lever 52.

Figure 3:
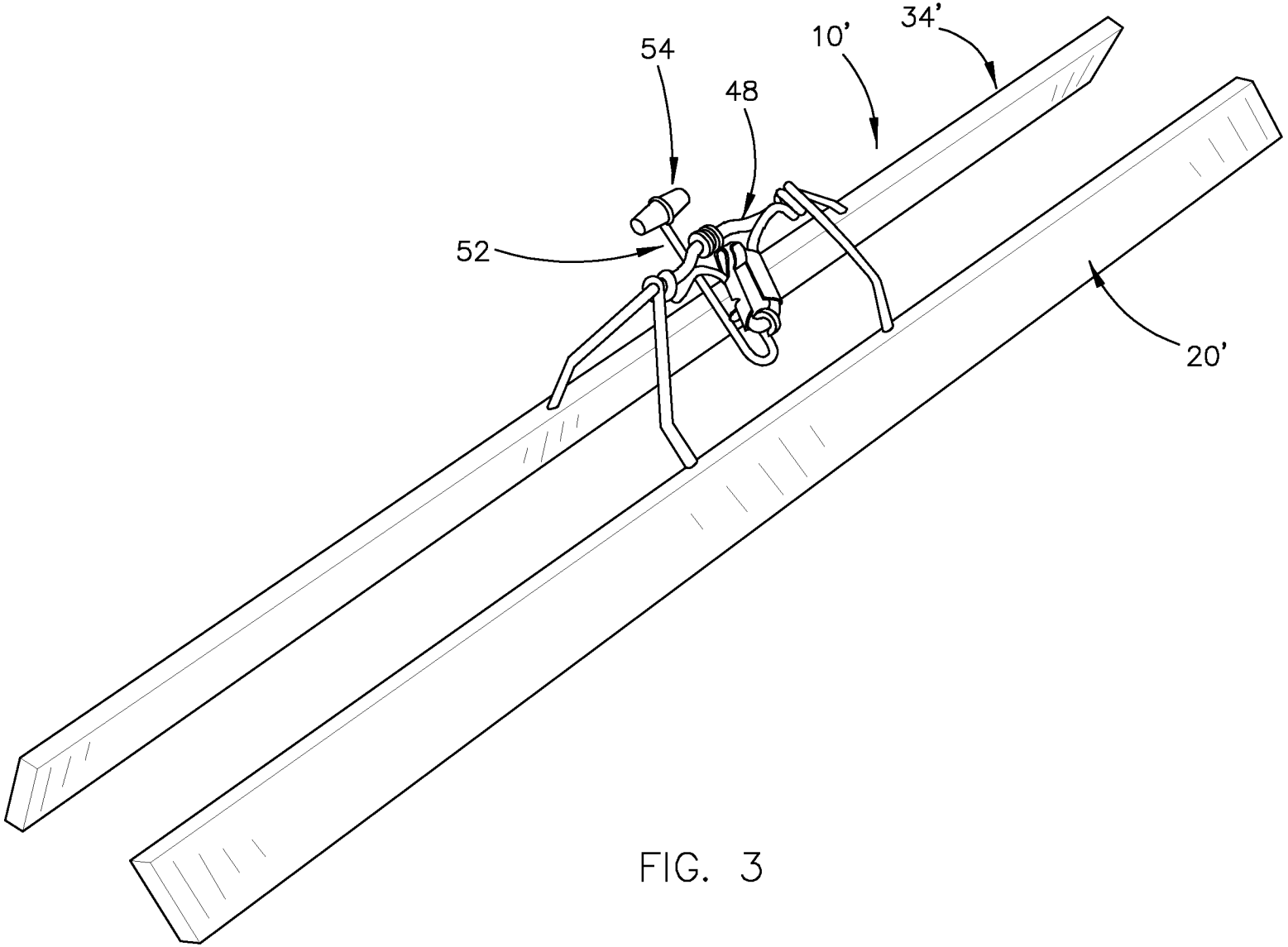
FIG. 3 is a perspective view of the embodiment of FIG. 2 with the protector being in the open position.
Figure 4:
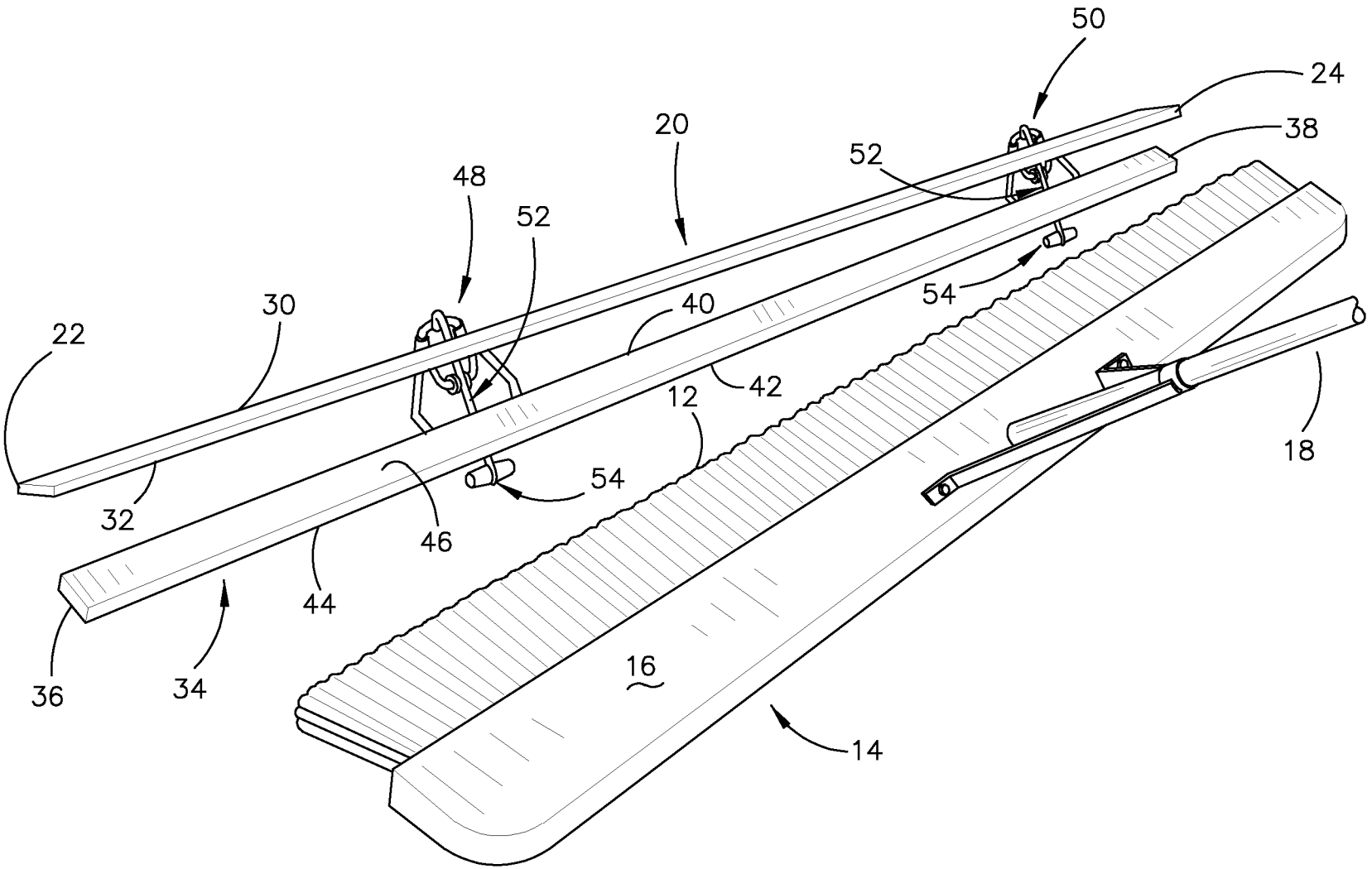
FIG. 4 is a perspective view illustrating the first embodiment in the open position about ready to be clamped onto the bristles of a concrete broom.
Figure 6:
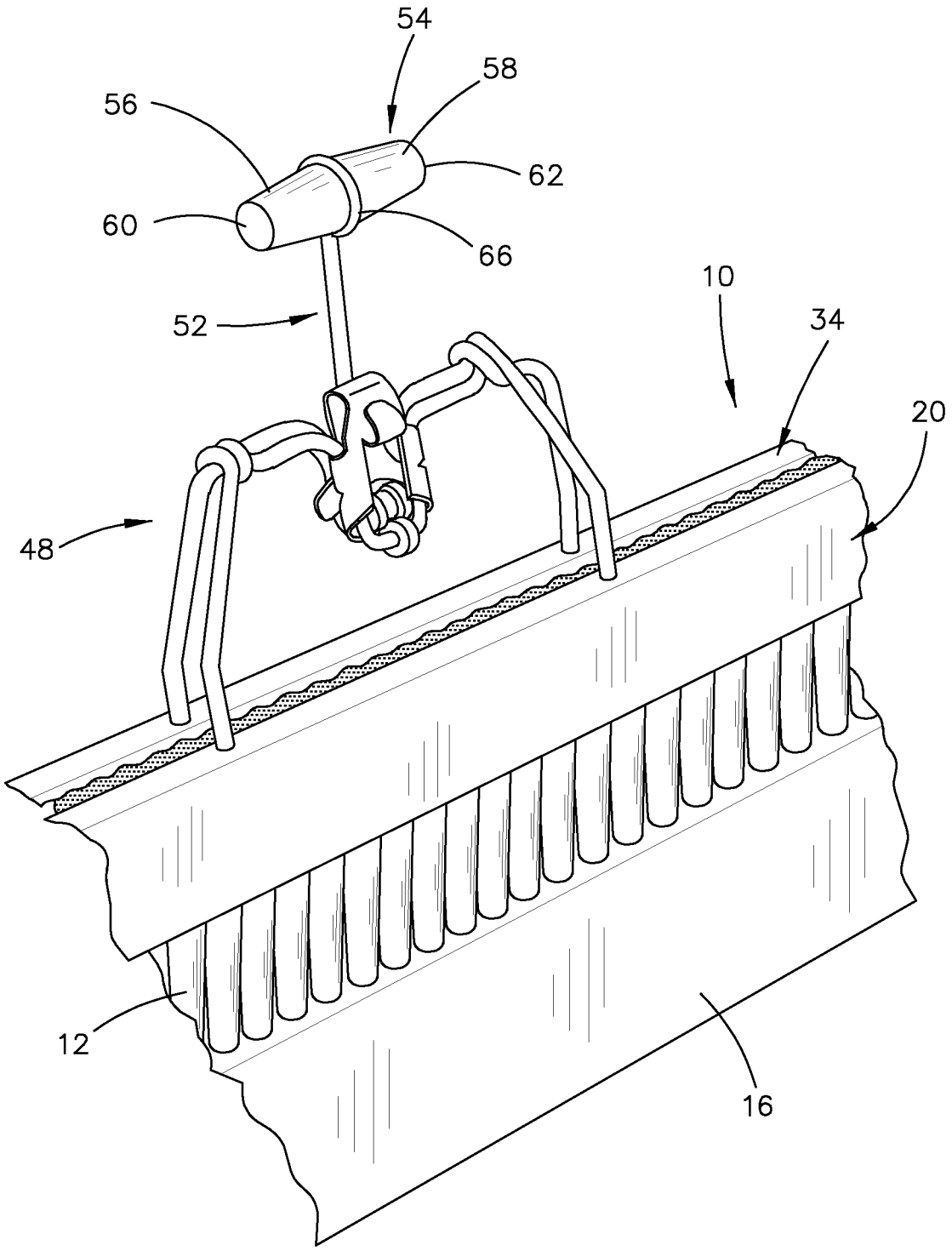
FIG. 6 is a partial perspective view illustrating the protector being clamped onto the bristles of a concrete broom; and which illustrates the handle or grip mounted on the outer end of the clamping lever.
Figure 6A:
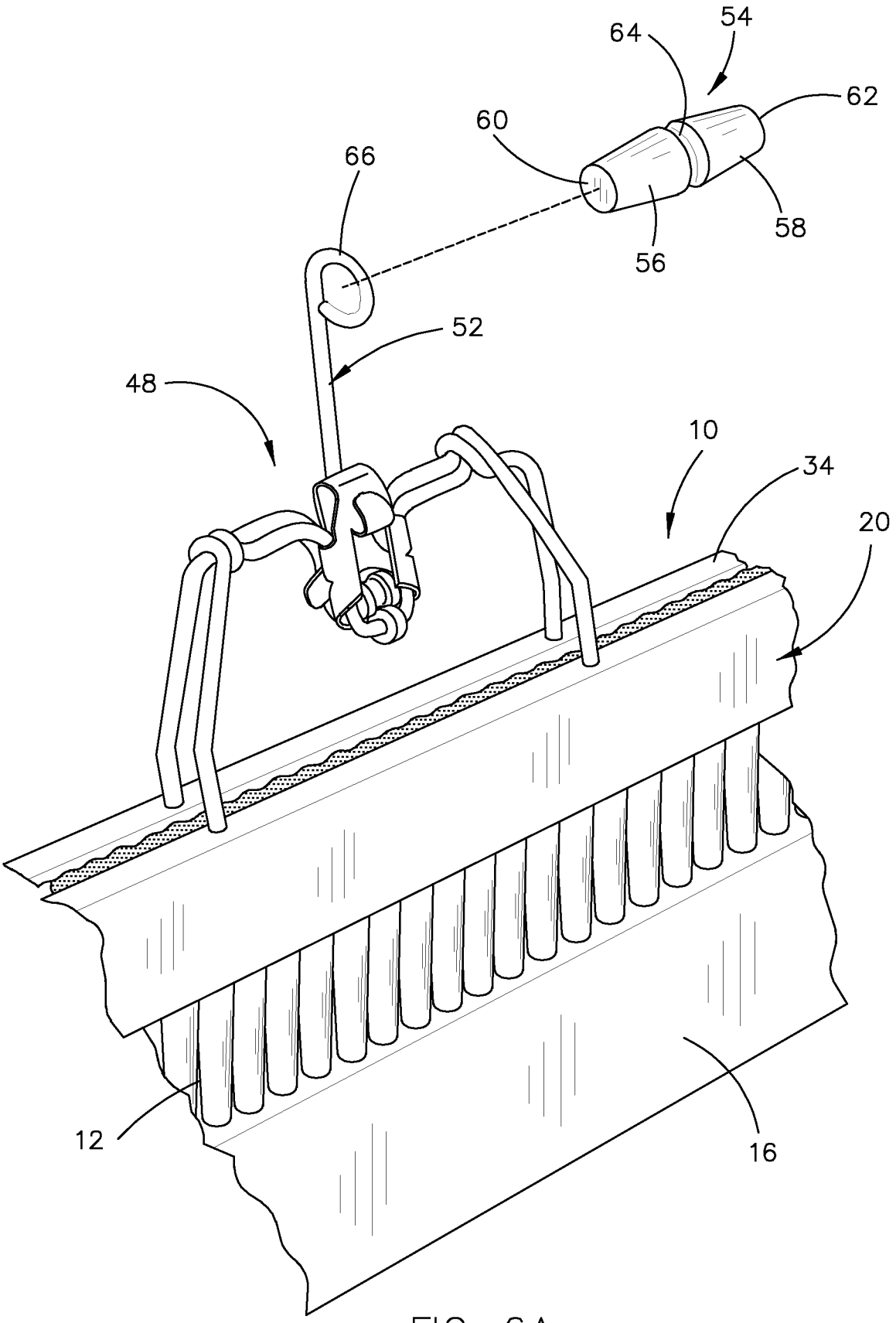
FIG. 6A is a partial exploded perspective view similar to FIG. 6 except that the handle or grip is shown in an exploded view.

When it is desired to protect the bristles 12 of the broom 14, the clamps 48 and 50 are moved to their open position which moves clamping members 20 and 34 to their open position of FIG. 4. The broom 14 is then maneuvered so that the outer ends of the bristles 12 are positioned between clamping members 20 and 34. The clamps 48 and 50 are then closed to compress the outer ends of the bristles 12 between the support members 20 and 32 to protect the same from damage (FIGS. 1, 5 and 6). The protector 10', shown in FIGS. 2 and 3, is used in the same manner as that just described with only clamp 48 being used.

During the movement of the clamps 48 and 50 between their open and closed positions, the person using the same will grasp the handle 54 in a convenient manner and will be able to easily move the associated clamp between the open and closed positions and vice versa.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A protector for the flexible bristles of a concrete broom, during periods of non-use of the concrete broom, with the bristles having inner ends embedded in an elongated, generally rectangular block and outer free ends positioned outwardly of the block, comprising:

a first elongated and rectangular flat clamping member having a first end, a second end, a first side edge, a second side edge, an inner surface and an outer surface;

a second elongated and rectangular flat clamping member having a first end, a second end, a first side edge, a second side edge, an inner surface and an outer surface;

a pivotal clamp pivotally connecting said first and second clamping members so that said first and second clamping members may be selectively movable with respect to one another between a closed clamping position and an open non-clamping position;

said pivot clamp including an elongated clamping lever having inner and outer ends;

a transversely disposed handle, having first and second ends forming a T-shaped handle, secured to said outer end of said clamping member;

said first and second clamping members, when in said open non-clamping position, permitting the outer free ends of the bristles of the concrete broom to be inserted therebetween;

said first and second clamping members, being movable to said closed clamping position, after the outer free ends of the bristles of the broom have been inserted therebetween, to clamp and compress the outer free ends of the bristles therebetween to protect the outer free ends of the bristles from damage.

2. The protector of claim 1 wherein said handle has first and second ends and wherein said upper end of said clamping lever is secured to said handle between said first and second ends thereof.

3. The protector of claim 2 wherein said handle has an annular groove formed therein and wherein said outer end of said clamping lever is positioned in said annular groove.

4. The protector of claim 1 wherein said handle includes first and second truncated conical portion having inner and outer ends.

5. The protector of claim 4 wherein said outer lever of said truncated conical portions are blunt.

6. The protector of claim 1 wherein said handle is comprised of wood.

* * * * *